United States Patent [19]

Hokamura et al.

[11] Patent Number: 4,514,445

[45] Date of Patent: Apr. 30, 1985

[54] PROCESS FOR FORMING A CORROSION RESISTANT COATING

[75] Inventors: Sadakazu Hokamura, Yamato; Seiji Yamada, Yokohama; Mitsutoshi Aritomi; Yuji Yoshida, both of Ami, all of Japan

[73] Assignees: Dai Nippon Toryo Co., Ltd., Osaka; Mitsubishi Yuka Fine Chemicals Co., Ltd., Tokyo, both of Japan

[21] Appl. No.: 549,735

[22] Filed: Nov. 8, 1983

[51] Int. Cl.[3] ..... B05D 3/02

[52] U.S. Cl. ..... 427/410; 427/386; 427/407.1; 427/409; 428/36

[58] Field of Search ..... 427/386, 409, 410, 407.1

[56] References Cited

U.S. PATENT DOCUMENTS

| | | | |
|---|---|---|---|
| 4,098,928 | 7/1978 | Noomen et al. | 427/203 |
| 4,147,675 | 4/1979 | Aritomi | 525/7 |
| 4,279,962 | 7/1981 | Meyer et al. | 427/410 X |
| 4,346,143 | 8/1982 | Young, Jr. et al. | 427/410 X |
| 4,396,650 | 8/1983 | Lange et al. | 427/409 |

*Primary Examiner*—Thurman K. Page

*Attorney, Agent, or Firm*—Oblon, Fisher, Spivak, McClelland & Maier

[57] ABSTRACT

A process for forming a corrosion resistant coating, which comprises (i) a step of priming a solvent-type coating composition on a substrate and drying it to form a prime coat, and (ii) a step of coating a radical-polymerizable and oxidation-polymerizable, room temperature curing type solventless coating composition on the prime coat and polymerizing it to form a cured coating.

4 Claims, No Drawings

PROCESS FOR FORMING A CORROSION RESISTANT COATING

BACKGROUND OF THE INVENTION

1. Field of the Invention

The present invention relates to a process for forming a corrosion resistant coating. More particularly, the present invention relates to a process for forming a corrosion resistant coating, which comprises applying a solvent-type coating composition onto a substrate and drying it to form a prime coat, and then finish-coating a solventless coating composition thereon.

2. Description of the Prior Art

For the protection of substrates such as tanks, bridges, steel-frame structures or pipes which need to be protected for a long period of time, various solvent-type and solventless coating compositions have been employed in various combinations for the primer coating and finish coating of such substrates.

For instance, taking into consideration the selectivity to the primer, etc., various combinations of coating compositions, such as oil type coating composition/phenol resin type coating composition/chlorinated rubber type coating composition, organic or inorganic zinc-rich paint/chlorinated rubber type coating composition, epoxy resin type coating composition/polyurethane type coating composition, and epoxy resin type coating composition/epoxy resin type coating composition, have been employed for the coatings.

However, even when a substrate is coated with such a coating system, it has been impossible to attain adequate protection of the substrate for an extended period of time by the coating if the substrate is subjected to a severe environment where water drops or ice always exists, as in the case of hydraulic pipes at a water-power plant. Namely, cool water is always circulated in the hydraulic pipes, and the outer surface thereof always have water drops thereby formed except for the winter time. Consequently, blisters are likely to form on the coating film in about 6 to 15 months after the application of the coating. On the other hand, in view of the rapid increase in the labour costs for the coating operation, it is desired to have a coating composition developed which has a long interval for recoating i.e. which has superior durability and is capable of protecting the substrate from corrosion over an extended period of time.

In general, corrosion of iron is known to occur when water and oxygen simultaneously exist on the surface of the iron substrate. Accordingly, it is considered possible to protect iron for a long duration with the coating film either by preventing one of the above components from penetrating through the coating film or by reducing the rate of the penetration.

However, none of the conventional coating systems provides a totally satisfactory combination of the finish coating composition with a primer coating composition in respect of the selectivity of the finish coating composition to the primer coating composition or in respect of the inter-layer adhesion.

SUMMARY OF THE INVENTION:

It is an object of the present invention to overcome or minimize the above-mentioned drawbacks of the conventional coating systems and to provide a process for forming a coating film having superior corrosion resistance and being durable for a long period of time without forming coating defects such as blisters, whereby it is yet possible to select a primer coating composition for the finish coating composition within a wide range of coating compositions.

One of the present inventors has previously proposed a composition comprising an oil-modified alkyd resin having an oil length of from 30 to 70% and modified with sorbic acid, crotonic acid or 2-(β-furyl) acrylic acid, and a polymerizable monomer (U.S. Pat. No. 4,147,675). It is another object of the present invention to provide a process for forming a coating film having superior corrosion resistance by means of a solventless coating composition containing such an oil-modified alkyd resin composition.

Thus, the present invention provides a process for forming a corrosion resistant coating, which comprises (i) a step of priming a solvent-type coating composition on a substrate and drying it to form a prime coat, and (ii) a step of coating a radical-polymerizable and oxidation-polymerizable, room temperature curing type solventless coating composition on the prime coat and polymerizing it to form a cured coating.

DETAILED DESCRIPTION OF THE PREFERRED EMBODIMENTS

The above-mentioned solvent-type coating composition to be used in the present invention is a composition wherein a vehicle is diluted with a volatile organic solvent. As such a composition, there may be mentioned, for instance, an oil-type coating composition, a solvent-type alkyd resin coating composition, a solvent-type epoxy resin coating composition, a solvent-type polyurethane coating composition, a solvent-type chlorinated rubber coating composition, and a solvent-type vinyl resin coating composition, or a mixture of at least two different types of these compositions.

The above-mentioned oil-type coating composition is a composition wherein a boiled drying oil such as tung oil or soybean oil, or such a boiled oil partially substituted by a petroleum resin or by an alkyd resin, is used as the vehicle. The above-mentioned alkyd resin coating composition is a composition wherein a resin obtained from an oil or its fatty acid, a polyhydric alcohol and a polybasic carboxylic acid or its anhydride by a known esterification reaction, is used as the vehicle. The esterification is carried out at a temperature of from 150° to 280° C., while removing water which forms during the reaction. The end of the reaction is determined by measuring the acid value or the amount of water formed by the esterification reaction.

From the viewpoint of the coating film properties, the acid value at the completion of the reaction is preferably at most 50.

As the oil or the fatty acid to be used for the preparation of the above-mentioned alkyd resin, there may be mentioned oils such as castor oil, cotton seed oil, dehydrated castor oil, linseed oil, safflower oil, soybean oil and tung oil, or fatty acids thereof.

The oil or the fatty acid is used preferably in an amount of from 5 to 70% by weight, based on the total composition for the preparation of the alkyd resin.

As the polyhydric alcohol to be used for the preparation of the alkyd resin, there may be mentioned, for instance, ethylene glycol, diethylene glycol, triethylene glycol, propylene glycol, dipropylene glycol, butanediol-1,3, butanediol-1,4, butanediol-2,3, pentanediol-1,5, hexanediol-1,6, neopentyl glycol, 2,2,4-trimethylpentanediol-1,3, hydrogenated bisphenol A, 2,2-di(4-hydroxypropoxyphenyl)propane, glycerol, pentaerythritol, diallyl ether, trimethylene glycol, 2-ethyl-1,3-hexanediol, trimethylol propane, cyclohexane dimethanol-1,4, 2,2,4-tetramethylcyclobutanediol-1,3, 1,4-bis(2-oxyethoxy)benzene, and 2,2,4,4-tetramethylcyclobutanediol-1,3. These alcohols may be used alone or in combination as a mixture.

As the saturated or unsaturated polybasic carboxylic acid or its anhydride to be used for the preparation of the alkyd resin, there may be mentioned, for instance, maleic acid, fumaric acid, itaconic acid, citraconic acid, mesaconic acid, maleic anhydride, phthalic anhydride, isophthalic acid, terephthalic acid, hexahydrophthalic anhydride, tetrahydrophthalic anhydride, tetrabromophthalic anhyhdride, tetrachlorophthalic anhydride, chlorendic acid, 3,6-endomethylene-tetrahydrophthalic anhydride, trimellitic anhydride, pyromellitic anhydride, methylnadic acid, succinic acid, adipic acid, sebacic acid, azelaic acid, an anthrathene-maleic anhydride adduct and a rosin-maleic anhydride adduct. These acids and anhydrides may be used alone or in combination as a mixture.

Further, it is possible to use a modified alkyd resin obtained by polymerizing the above-mentioned alkyd resin with a polymerizable monomer which will be described hereinafter.

The epoxy resin coating composition to be used in the coating process of the present invention, is a composition comprising an epoxy resin, a hardener and, optionally, various pigments, solvents or other additives.

As the epoxy resin, there may be mentioned a resin having at least two epoxy groups in its molecule, for isntance, (1) a bisphenol type resin synthesized by the reaction of bisphenol A or bisphenol F with epichlorohydrin or methylepichlorohydrin, such as the ones known by the trade names Epikote #807, #827, #828, #1001, #1004, #1007 and #1009, manufactured by Yuka Shell Epoxy Co., the ones known by the trade names ERL #2772 and #2774 and EKR 2002, manufactured by Union Carbide Co., the ones known by the trade names Araldite GY-#250, #260, #280, #6071, #6084 and #6099, manufactured by Ciba Geigy Corp., the ones known by the trade names AER #330, #331, #332, #661 and #664, manufactured by Asahi Chemical Industry Co., Ltd. or the ones known by the trade names Epiclon #800, #1000 and #4000, manufactured by Dainippon Ink & Chemicals Inc., (2) a resin synthesized by the reaction of a glycol with epichlorohydrin or methylepichlorohydrin, such as the one known by the trade name DER #736 manufactured by Dow Chemical Co., (3) a resin obtained by reacting a phenol with formaldehyde in the presence of an acidic or alkaline catalyst to obtain a novolak or resol and reacting thus obtained novolak or resol with epichlorohydrin or methylepichlorohydrin, such as the ones known by the trade names DEN #431, #438 and #448, manufactured by Dow Chemical Co. or the ones known by the trade names ECN #1235, #1273, #1280 and #1290, manufactured by Ciba Geigy Corp., (4) a resin synthesized by oxidizing a double bond within a molecule, such as the ones known by the trade name Unox #201, #206, #207, #221 and #289, manufactured by Union Carbide Co., the ones known by the trade names Araldite GY #175 and #176, manufactured by Ciba Geigy Corp. or the ones known by the trade names Oxilone #2001 and #2002, manufactured by FMC Corp., (5) a resin obtained by reacting a halogenated phenol with epichlorohydrin or methylepichlorohydrin, such as the ones known by the trade names DER #511, #542 and #580, manufactured by Dow Chemical Co. or the ones known by the trade names Araldite #8011 and #8047, manufactured by Ciba Geigy Corp., (6) a resin obtained by reacting epichlorohydrin or methylepichlorohydrin with an addition product of a phenol with ethylene oxide or propylene oxide, such as the one known by the trade names EP #4000 and #4001, manufactured by Asahi Electro-Chemical Co. Ltd., (7) a resin obtained by reacting a carboxylic acid with epichlorohydrin or methylepichlorohydrin, such as the ones known by the trade names AK #737 and #838, manufactured by Nippon Kayaku Kabushiki Kaisha, the ones known by the trade names Showdine #508, #540 and #550, manufactured by Showa Denko K.K. or the ones known by the trade names Epiclon #200, #300, #400 and #500, manufactured by Dainippon Ink & Chemicals Inc. These resins may be used alone or in combination as a mixture.

It should be understood that other epoxy compounds and their derivatives fall within the scope of the present invention so long as they are readily inferred from the above-mentioned compositions. For instance, as such compounds, there may be mentioned polyol-type epoxy resins, cyclic epoxy resins and halogen-containing epoxy resins. Further, in order to improve the workability, the coating properties or the coating condition, it is possible to incorporate a monoepoxy compound having only one epoxy group to the above-mentioned epoxy resin in an amount of upto 20% by weight relative to the above-mentioned epoxy resin. As such an additional monoepoxy compound, there may be mentioned, for instance, allylglycidyl ether, 2-ethylhexylglycidyl ether, methylglycidyl ether, butylglycidyl ether, phenylglycidyl ether, styreneoxide, cyclohexeneoxide and epichlorohydrin. Further, in addition to the above, there may be incorporated a petroleum resin, a melamine resin, a urea resin, a phenol resin, a hydrocarbon resin (e.g. polybutadiene), an alkyd resin, a polyester resin, maleic oil, urethane oil, coal tar or asphalt.

As the curing agent for the above-mentioned epoxy resin, amino-type compound such as an amine adduct, a polyamide, a polyamine may be used alone or in combination as a mixture. For the crosslinking reaction with the above-mentioned epoxy resin, these amino-type compounds must contain at least two nitrogen atoms per molecule and functional hydrogen atoms attached to the nitrogen atoms.

As the amino-type curing agent to be used in the present invention, there may be mentioned commercially available polyamide resins such as those known by the trade names Tohmide Y-25, Y-245, Y-2400 and Y-2500, manufactured by Fuji Chemical Industry Co., Ltd., those known by the trade names Genamid 2000, Versamid 115 and 125, and DSX-1280, manufactured by Dai-Ichi General Co., Ltd., those known by the trade names Sunmide 320 and 330, manufactured by Sanwa Chemical Industry Co., Ltd., and those known by the trade names Epikure 3255 and 4255, manufactured by Yuka Shell Epoxy Co., Ltd.; amine adduct resins such as those known by the trade names Tohmide 238, Fujicure #202, and #5000, manufactured by Fuji Chemical Industry Co., Ltd., and those known by the trade names Adeka Hardener EH-212, EH-220, EH-240 and EH-531, manufactured by Asahi Electro-Chemical Co., Ltd.; heterocyclic diamine derivatives such as those known by the trade names Epomate B-002, C-002 and S-005, manufactured by Ajinomoto Co., Ltd.; and aliphatic polyamines such as those known by the trade names Sunmide T-100, D-100 and P-100, manufactured by Sanwa Chemical Industry Co., Ltd. These curing agents may be used alone or in combination as a mixture depending upon the particular purpose.

The polyurethane resin coating composition to be used in the present invention is a composition comprising, as the vehicle, a one-pack type, two-pack type or moisture-curable type polyurethane resin which is obtainable from a hydroxyl group-containing compound and an isocyanate group-containing compound, optionally by using a modifying agent.

The one-pack type polyurethane resin may be prepared by reacting a polyhydric alcohol having at least two hydroxyl groups in the molecule, any optional active hydrogen-containing compound such as a phenol-type, alcohol-type, active methylene-type, mercaptan-type, acid amide-type, imide-type, amine-type, imine-type, imidazole-type, urea-type, carbamate-type, oxime-type or sulfite-type compound (which is usually called "a blocking agent"), and an isocyanate group-containing compound by a conventional method.

The two-pack type polyurethane resin is obtainable in the form of a two-pack system composition comprising a polyisocyanate compound having at least two isocyanate groups in the molecule and a compound having at least two active hydrogen groups in the molecule.

The moisture curable type polyurethane resin is obtainable from a polyisocyanate compound having at least two isocyanate groups in the molecule.

In the present invention, such a one-pack type, two-pack type or moisture curable type polyurethane resin may be the one modified in accordance with a conventional method.

As the above-mentioned polyhydric alcohol, there may be mentioned ethylene glycol, propylene glycol, diethylene glycol, butylene glycol, 1,6-hexane diol, neopentyl glycol, hexane triol, trimethylol propane, glycerol, castor oil or pentaerythritol. As the compound having at least two active hydrogen groups, there may be mentioned a polyester, a polyether or a hydroxyl group-containing acrylic resins.

As the above-mentioned polyisocyanate compound, there may be mentioned 2,4-tolylene diisocyanate, 2,6-tolylene diisocyanate, 1,6-hexamethylene diisocyanate, 4,4'-diphenylmethane diisocyanate, trans-cyclobutane-1,2-bismethyl diisocyanate, 1,3-phenylene diisocyanate, isopropylidene-bis(4-phenylisocyanate), bis(4-isocyanatephenyl)sulfone, 4,4'-diphenylether diisocyanate, bisphenylene diisocyanate, 3,3'-dimethyl-4,4'-biphenylene diisocyanate, cyclohexylmethane-4,4'-diisocyanate, xylylene diisocyanate or 2,4-cyclohexylene diisocyanate or a reaction product of an excess of such an isocyanate compound with a polyhydric alcohol. These may be used alone or in combination as a mixture.

As the above-mentioned blocking agent, there may be mentioned phenol, cresol, methanol, cyclohexanol, dimethyl maronate, butylmercaptan, thiophenol, acetanilide, acetanisidide, succinic acid imide, diphenyl amine, 2-ethylimidazole, urea, thiourea, phenyl N-phenylcarbamate, ethylene imine, formaldoxime, methyl ethyl ketoxime and sodium bisulfite.

The above-mentioned chlorinated rubber coating composition to be used in the present invention is a composition which comprises, as the major vehicle, a chlorinated rubber such as the one known by the trade name Superchlon CR 10 or CR 20 commercially available from Sanyo Kokusaku Pulp K.K. The chlorinated rubber is usually employed in combination with chlorinated paraffin, an epoxy resin or an alkyd resin.

The above-mentioned vinyl resin coating composition is a composition which comprises, as the vehicle, a resin obtainable by the copolymerization of the following polymerizable monomers.

As such polymerizable monomers, there may be mentioned, for instance, styrene, methylstyrene, chlorostyrene, tert-butylstyrene, methyl (meth)acrylate, ethyl (meth)acrylate, butyl (meth)acrylate, 2-ethylhexyl (meth)acrylate, lauryl (meth)acrylate, $\beta$-hydroxyethyl (meth)acrylate, $\beta$-hydroxypropyl (meth)acrylate, 4-hydroxybutyl (meth)acrylate, a mono(meth)acrylate of glycerol trimethylolpropane, glycidyl (meth)acrylate, N-butoxymethyl (meth)acrylamide, N-tert-butyl (meth)acrylamide, dimethylaminoethyl (meth)acrylate, diacetone acrylamide, vinylpyrrolidone, N-methylol acrylamide, acrylamide, (meth)acrylic acid, crotonic acid, vinyl acetate, vinyl chloride, (meth)acrylonitrile and ethylene glycol mono(meth)acrylate, or derivatives thereof. These monomers may be used alone or in combination as a mixture.

In the present invention, it is particularly preferred to use a bisphenol type epoxy resin as the vehicle for the solvent-type coating composition for the prime coat, whereby it is possible to obtain a coating film which is superior not only in the corrosion resistance but also in the water resistance, the moisture resistance, the alkali resistance and the gasoline resistance.

To the above-mentioned various vehicles, there may be incorporated, as the case requires, a filler pigment such as talc, barium sulfate, calcium carbonate or barite powder; a coloring pigment such as titanium oxide, zinc white, iron oxide red, micaceous iron oxide, chrome yellow, chromium oxide, ultramarine blue, phthalocyanine blue, carbon black or iron black; metal powder such as aluminum or zinc powder; a reinforcing pigment such as glass fiber, glass flakes, mica powder, asbestos or synthetic silica; and an anti-corrosive pigment, as well as a thickener, an anti-corrosive agent, an anti-foaming agent, a precipitation-preventive agent, a curing accelerator, a chelate-reaction accelerator and an adjuvant resin.

According to the process of the present invention, firstly the above-mentioned solvent-type primer coating composition is applied to a substrate with its surface preliminarily cleaned or coated with a shop primer. Then, the applied coating composition is dried at room temperature or by an accelerated drying operation. For the application of the coating composition, a conventional method such as brush coating, spray coating or air-less spray coating may be employed. The dried coating film of the prime coat should preferably have a thickness of from about 30 to about 200 $\mu$m.

On the other hand, as the above-mentioned radical-polymerizable and oxidation-polymerizable, room temperature curing type solventless coating composition to be used in the present invention, it is most preferred to employ a composition which is composed essentially of a curing catalyst and a resin component comprising (A) from 30 to 70% by weight of an oil-modified alkyd resin having an oil length of from 30 to 70% and modified with an $\alpha,\beta$-unsaturated monocarboxylic acid selected from the group consisting of sorbic acid, crotonic acid and 2-($\beta$-furyl)acrylic acid, the content of the $\alpha,\beta$-unsaturated monocarboxylic acid in the alkyd resin being from 0.5 to 30% by weight, and (B) from 70 to 30% by weight of a polymerizable monomer in which the ingredient (A) is dissolved.

The solventless coating composition of the present invention is curable by room temperature drying or accelerated drying to give a coating film which is superior in the surface smoothness, the hardness, the bending resistance, the impact resistance and the water resistance.

Ingredient (A): oil-modified alkyd resin modified with an unsaturated carboxylic acid The ingredient (A) as set forth above is substantially the same as oil-modified alkyd resins which are known heretofore or may be provided in the future except that it has been modified with a specific α,β-unsaturated monocarboxylic acid. The method by which this modification with the α,β-unsaturated monocarboxylic acid is carried out is also the same as the ordinary method of modifying an alkyd resin with a fatty acid.

Accordingly, examples of the polybasic acid of the alkyd resins are aromatic, aliphatic or alicyclic saturated polybasic acids such as phthalic anhydride, isophthalic acid, tetrahydrophthalic anhydride, adipic acid, sebacic acid, azelaic acid, branched 1,2,3,6-tetrahydrophthalic anhydride derivatives which are Diels-Adler adducts of an isoprene dimer having conjugated double bonds and maleic anhydride such as maleinated myrcene, maleinated alloocimene, maleinated ocimene, 3-(β-methyl-2-butenyl)-5-methyl-1,2,3,6-tetrahydrophthalic acid or anhydride thereof, hexahydrophthalic anhydride, 4-methyl-tetrahydrophthalic anhydride, trimellitic acid, and mixtures of two or more of these acids.

Within limits wherein gelation will not occur, a part of given saturated polybasic acid such as the one mentioned above may be substituted by an unsaturated polybasic acid such as, for example, maleic acid, maleic anhydride, fumaric acid, and itaconic acid. Of these, a particularly preferable polybasic acid is a combination of phthalic acid and 3-(β-methyl-2-butenyl)-5-methyl-1,2,3,6-tetrahydrophthalic anhydride (hereinafter referred to by the abbreviation MBTHP). When MBTHP is used in the polybasic acid, it has a remarkable effect in lowering the viscosity of the alkyd resin.

Examples of polyhydric alcohols which can be used for the polyhydric alcohol ingredient are ethylene glycol, diethylene glycol, propylene glycol, dipropylene glycol, 1,4-butanediol, neopentyl glycol, glycerol, pentaerythritol, trimethylol propane, trimethylolethane, tris(2-hydroxyethyl)isocyanurate, and mixtures of two or more of these alcohols. In general, dihydric, trihydric and tetrahydric alcohols of from 2 to 12 carbon atoms are usually preferable.

For the fat, oil, or fatty acid for forming the oil-modified alkyd resin, those which can be dried in air are used, examples being oils and fats such as linseed oil, soybean oil, tall oil, and safflower oil, dehydrated castor oil or fatty acids separated from these oils. Particularly desirable fatty acids are dehydrated castor oil fatty acid and safflower oil fatty acid containing more than 60 mole percent in the fatty acid moiety of linoleic acid and linolenic acid independently or as a mixture system.

According to this invention, the oil-modified alkyd resin comprising the above described three indispensable ingredients is further modified with an α,β-unsaturated monocarboxylic acid. α,β-Unsaturated monocarboxylic acids which are suitable for use in this invention are crotonic acid, sorbic acid, and 2-(β-furtyl) acrylic acid, as mentioned hereinbefore, sorbic acid being particularly preferable. Since this acid undergoes radical copolymerization with the ingredient (B) in the composition of this invention and thereby contributes to hardening of the formed film, it is highly effective particularly for improving the hardness and the water resistance of the formed coating film.

Of these four indispensable ingredients, the oil-modified alkyd resin is prepared by an ordinary process. Specific examples are the process wherein the α,β-unsaturated monocarboxylic acid, the fatty acid, the polybasic acid, and the polyhydric alcohol are simultaneously charged into the reaction system and caused to react, and the process in which the fatty acid, the polybasic acid, and the polyhydric alcohol are first caused to react, and then the α,β-unsaturated monocarboxylic acid is caused to react with these reactants. The latter process is desirable on the point of preventing gelation during this preparation process. Furthermore, whatever method is used, it is desirable that an agent for preventing gelation such as hydroquinone, for example, be added in order to prevent gelation during reaction.

An oil-modified alkyd resin suitable for use in this invention has an oil length of 30 to 70%, preferably 55 to 65%. We have found that if the oil length is less than 30%, it will give rise to a lowering of resistance such as water resistance of the formed coating film. On the other hand, if this oil length is higher than 70%, it gives rise to undesirable results such as a lowering the hardness of the formed film at the initial stage of drying and a deterioration of the surface smoothness.

The content of the α,β-unsaturated monocarboxylic acid in the oil-modified alkyd resin which has been modified with the α,β-unsaturated monocarboxylic acid is 0.5 to 30% by weight, preferably 2 to 15% by weight. We have found that if this content is less than 0.5%, there will be no appreciable effect in improving the water resistance and hardness of the formed coating film. On the other hand, if this content exceeds 30%, gelation will very readily occur during the alkyd preparation, which will thereby become difficult.

The acid value of the oil-modified alkyd resin modified with the α,β-unsaturated monocarboxylic acid which is used in this invention is ordinarily of the order of 15 to 40, and the hydroxyl value is ordinarily from 20 to 150.

Ingredient (B): polymerizable monomer

For this monomer, it is possible to use any monomer which is capable of undergoing radical polymerization, has at least one ethylenically unsaturated bond, and is capable of dissolving the above described ingredient (A) to a desired concentration as described in detail hereinafter. However, since it is desired to provide a resin composition which can be hardened at room temperature, a polymerizable monomer of high boiling point of an order exceeding 200° C. is especially preferable.

Specific examples of polymerizable monomers suitable for use as the ingredient (B) in this invention are as set forth below. These monomers can be used in combination as a mixture.

Monoacrylates and monomethacrylates of monohydric or polyhydric alcohols having 2 to 20, preferably 2 to 18 carbon atoms, preferably monoacrylates and monomethacrylates of monohydric and dihydric alcohols.

Specific examples of these monoacrylates and monomethacrylates are as set forth below. In the following list, the term "(meth)acrylate" means acrylate and methacrylate: 2-hydroxyethyl (meth)acrylate, 2-hydroxypropyl (meth)acrylate, 2-hydroxyethoxyethyl (meth)acrylate, 4-hydroxybutyl (meth)acrylate, 5-hydroxypentyl (meth)acrylate, 6-hydroxyhexyl (meth-)acrylate, neopentylglycol mono(meth)acrylate, 3-butoxy-2-hydroxypropyl (meth)acrylate, 2-hydroxy-1- or -2-phenylethyl (meth)acrylate, polypropylene glycol mono(meth)acrylate, glycerine mono(meth)acrylate monohalfmaleate, diethyleneglycol mono(meth)acrylate, cyclohexyl (meth)acrylate, benzyl (meth)acrylate, 2-ethoxyethyl (meth)acrylate, 2-butoxyethyl (meth)acrylate, and tetrahydrofuryl (meth)acrylate.

Examples are di-, tri-, and tetraesters of alcohols each having at least two hydroxyl groups and having 2 to 20 carbon atoms, preferably 2 to 6 carbon atoms, preferably dihydric, trihydric, and tetrahydric alcohols and acrylic acid and methacrylic acid.

Specific examples of these di-, tri-, and tetra-acrylates and methacrylates are: ethyleneglycol di(meth)acrylate, diethyleneglycol di(meth)acrylate, 1,4-butanediol di(-meth)acrylate, 1,6-hexanediol di(meth)acrylate, neopentylglycol di(meth)acrylate, trimethylolpropane tri(-meth)acrylate, pentaerythritol tri(meth)acrylate, pentaerythritol tetra(meth)acrylate, and glycerine monoacrylate monomethacrylate.

It is possible to use any monomer having a relatively low boiling point, for example, styrene, methylmethacrylate and divinyl benzene.

Examples of particularly suitable polymerizable monomers for the ingredient (B) of this invention are: tetrahydrofurfuryl acrylate, 2-hydroxyethyl methacrylate, 2-hydroxypropyl acrylate, 3-butoxy-2-hydroxypropyl acrylate, 1,4-butanediol diacrylate, 1,6-hexanediol diacrylate, and trimethylolpropane tri(meth)acrylate. The solventless coating composition according to this invention contains the above described indispensable two ingredients (A) and (B) in a specific ratio.

The quantity of the ingredient (A) is from 30 to 70% by weight, preferably 40 to 60% by weight, of the total weight of these two ingredients (A) and (B). If this quantity exceeds 70%, the resin composition will acquire a remarkably high viscosity, and its preparation and utilization, for example, as a coating composition, will become difficult. On the other hand if this quantity is less than 30%, the water resistance, impact resistance, and bending resistance of the formed coating film will deteriorate.

The quantity of the ingredient (B) is from 70 to 30% by weight, preferably 60 to 40% by weight, of the total weight of the two ingredients (A) and (B).

To the above-mentioned composition comprising the oil-modified alkyd resin and the polymerizable monomer, there may be incorporated various additives, for example, a coloring pigment such as titanium oxide, carbon black, iron oxide or ultramarine blue; a filler pigment such as talc, zinc white or barium sulfate; and anti-corrosive pigment such as minium, zinc powder or zinc chromate; a coating film surface improver such as polyethylene glycol; a filler; a stabilizer; a pigment disperser; and a thixotropic agent.

The solventless coating composition of this invention can be cured by using a curing catalyst, that is, a redox catalyst comprising an organic peroxide and a reducing agent and used, if necessary, in conjunction with a drier (metallic soap) such as manganese naphthenate or cobalt naphthenate. Examples of curing catalysts are:

(a) A combination of methyl ethyl ketone peroxide and cobalt naphthenate;

(b) A combination of a redox catalyst comprising benzoyl peroxide and dimethylaniline and cobalt naphthenate or manganese naphthenate; and (c) A combination of cyclohexanone peroxide and cobalt naphthenate.

Of these curing agent, cobalt naphthenate is particularly suitable because it not only participates as a reducing agent in radical generation but functions also as a drier participating also in the oxidation hardening of the oil-modified alkyd resin.

The above described catalyst is used in proportions of 0.5 to 5 parts by weight of the organic peroxide and of 0.01 to 5 parts by weight of the reducing agent relative to 100 parts by weight of the resin composition comprising (A) and (B).

The process for forming a coating film according to the present invention comprises applying the above-mentioned solvent-type coating composition on a substrate and drying it to form a prime coat, and then applying the above-mentioned solventless coating composition on the prime coat by a conventional coating method such as brush coating, spray coating or air-less spray coating so that the thickness of the dried coating film becomes to be within a range of from 30 to 500 μm, preferably from 40 to 350 μm, followed by drying. The solventless coating composition is cured by radical polymerization and oxidation polymerization during the drying step, to form a coating film.

According to the process of the present invention, it is possible to obtain a coating film which is superior in the interlayer adhesion and which is free from blisters, i.e. superior in the corrosion resistance. Thus, the process of the present invention has a significant industrial value in that it provides the following advantages:

(1) It is possible to obtain a coating film which is superior in the resistance against the formation of blisters.

(2) The primer coating composition may be selected from a wide range of coating compositions.

(3) The oxygen permeability of the coating film is minimum. For instance, the oxygen permeability of the finish coating film of the present invention is about 1/10 of that of a chlorinated rubber coating film.

(4) The finish coating composition is a solventless coating composition, whereby a high-build coating i.e. a thick coating, is possible.

Now, the present invention will be described in detail with reference to Examples. However, it should be understood that the present invention is by no means restricted by these specific Examples. In the Examples, "parts" or "%" is meant for "parts by weight" or "% by weight", respectively.

EXAMPLE 1

(i) Preparation of an oil-type coating composition

To 34.0 parts of boiled linseed oil, 6.0 parts of an iron oxide red coloring pigment, 52.3 parts of calcium carbonate, 4.0 parts of mineral spirit, 0.2 part of an anti-skinning agent, 2.5 parts of a drier and 1.0 part of a thixotropic agent were added, and the mixture was kneaded by rollers. Prior to use, 23.5 parts of lead suboxide was mixed thereto to obtain an oil-type coating composition (I).

(ii) Preparation of a radical-polymerizable and oxidation-polymerizable, room temperature curing type solventless coating composition Into a four-necked flask equipped with a stirrer, a water separator, a condenser and a nitrogen gas supply tube, 52.9 parts of soybean oil fatty acid, 14.9 parts of phthalic anhydride, 11.7 parts of MBTHP, 5.5 parts of glycerol and 15.1 parts of pentaerythritol were fed, and 0.1 part of hydroquinone and 4.0 parts of xylene were further added. Then, the mixture was reacted in a nitrogen gas stream at 220° C.

When the acid value of the formed alkyd reached 40, 7.1 parts of sorbic acid and 0.2 part of hydroquinone were added, and the reaction was continued until the acid value reached 20, whereby an oil-modified alkyd resin having a sorbic acid content of 7.1% and an oil length of 55.3% was obtained.

To 55.0 parts of the oil-modified alkyd resin, 10.0 parts of 2-hydroxypropyl acrylate and 35.0 parts of 1,4-butanediol diacrylate were added and stirred to obtain a resin composition having a viscosity of 1.6 poise (25° C.) 98.0 Parts of this resin composition, 0.98 part of cobalt naphthenate (metal content: 6%), 0.15 part of methyl ethyl ketone oxime, 0.001 part of a silicone-type anti-foaming agent and 0.4 part of an asbestos-type thixotropic agent were mixed. Immediately prior to use, 1.7 parts of methyl ethyl ketone peroxide and 66.4 parts of an aluminum paste were added to obtain a solventless coating composition (A).

By using the above-mentioned oil-type coating composition (I) as the primer coating composition and the above-mentioned solventless coating composition (A) as the finish coating composition, the primer coating and the finish coating were applied, respectively, by brush coating under the conditions shown in Table 1, followed by drying, to obtain a coating film. The coating film was subjected to various tests. The results thereby obtained are shown in Table 2.

EXAMPLE 2

(i) Preparation of a solvent-type alkyd resin coating composition 35.0 Parts of a soybean oil-modified alkyd resin (oil length: 65%, non-volatile component: 70%, viscosity at 20° C.: 55 stokes' poise), 5.0 parts of a linseed oil/soybean oil type boiled oil, 13.0 parts of an iron oxide red coloring pigment, 43.5 parts of calcium carbonate, 0.2 part of an anti-skinning agent, 1.0 part of a thixotropic agent and 2.5 parts of a mixed drier were kneaded by rollers. Prior to use, 26.6 parts of lead suboxide powder was added thereto to obtain a solvent-type alkyd resin coating composition (II).

(ii) Preparation of a radical-polymerizable and oxidation-polymerizable, room temperature curing type solventless coating composition The reaction was conducted in the same manner as in Example 1 (ii) except that 56.5 parts of dehydrated castor oil fatty acid, 15.0 parts of phthalic anhydride, 11.9 parts of MBTHP, 6.7 parts of glycerol, 13.5 parts of pentaerythritol and 3.5 parts of crotonic acid were used, whereby an oil-modified alkyd resin having a crotonic acid content of 3.5% and an oil length of 59.0% was obtained.

To 55.0 parts of the oil-modified alkyd resin, 10.0 parts of 2-hydroxypropyl acrylate and 35.0 parts of 1,4-butanediol diacrylate were added, stirred and dissolved to obtain a solventless resin composition having a viscosity of 2.3 poise (25° C.).

Immediately prior to use, 1.7 parts of methyl ethyl ketone peroxide and 66.7 parts of an aluminum paste were added thereto to obtain a solventless coating composition (B).

By using the above-mentioned solvent-type alkyd resin coating composition (II) as the primer coating composition and the solventless coating composition (B) as the finish coating composition, the primer coating and the finish coating were applied, respectively, by brush coating under the conditions shown in Table 1. After drying, the formed coating film was subjected to various tests. The results thereby obtained are shown in Table 2.

EXAMPLE 3

(i) Preparation of a solvent-type epoxy resin coating composition (Main component)

30.0 Parts of a xylene solution containing 70% of a solid bisphenol A type epoxy resin (epoxy equivalent: 450–500), 3.0 parts of a liquid bisphenol A type epoxy resin (epoxy equivalent: 230–270), 40.0 parts of talc, 5.0 parts of an iron oxide red coloring pigment, 1.0 part of thixotropic agent, 10.0 parts of xylene, 10.0 parts of cellosolve and 1.0 part of an additive were kneaded by rollers to obtain a main component.

(Curing agent)

50.0 Parts of a modified heterocyclic polyamine (amine value: 87 mgKOH/g) was dissolved in 50 parts of xylene to obtain a curing agent. Prior to use, the main component and the curing agent were mixed in a weight ratio of 80:20 to obtain a solvent-type epoxy resin coating composition (III).

(ii) Preparation of a radical-polymerizable and oxidation-polymerizable, room temperature curing type solventless coating composition The reaction was conducted in the same manner as in Example 1 (ii) except that 54.6 parts of dehydrated castor oil fatty acid, 15.1 parts of phthalic anhydride, 12.0 parts of MBTHP, 7.7 parts of glycerol, 12.1 parts of pentaerythritol and 5.4 parts of 2-(β-furyl)acrylic acid were used, whereby an oil-modified alkyd resin having an acid value of 20, a 2-(β-furyl)acrylic acid content of 5.4% and an oil length of 57.1% was obtained.

To 55 parts of the oil-modified alkyd resin, 10.0 parts of 2-hydroxypropyl acrylate and 35.0 parts of 1,4-butanediol diacrylate were added, stirred and dissolved to obtain a solventless resin composition having a viscosity of 2.5 poise (25° C.). To 65 parts of this composition, 10.0 parts of talc, 5.0 parts of barium sulfate, 20.0 parts of titanium oxide, 0.7 part of cobalt naphthenate (metal content: 6%), 0.09 part of methyl ethyl ketone oxime, 0.001 part of a silicone type anti-foaming agent and 0.3 part of an asbestos type thixotropic agent were added, and the mixture was kneaded by rollers. Prior to use, 1 part of methyl ethyl ketone peroxide was added thereto to obtain a solventless coating composition (C).

By using the above-mentioned solvent-type epoxy resin coating composition (III) as the primer coating composition and the above-mentioned solventless coating composition (C) as the finish coating composition, the primer coating and the finish coating were applied, respectively, by brush coating under the conditions shown in Table 1. After drying, the formed coating film was subjected to various tests. The results thereby obtained are shown in Table 2.

EXAMPLE 4

(i) Preparation of a solvent-type polyurethane resin coating composition (Main component)

5.0 Parts of castor oil, 1.0 part of trimethylolpropane, 30.0 parts of a hydroxyl group-containing solid bisphenol type epoxy resin solution (epoxy equivalent: 450–500, 70% xylene solution), 6.0 parts of methyl isobutyl ketone, 45.0 parts of talc, 5.0 parts of an iron oxide red coloring pigment, 2.4 parts of a thixotropic agent and 5.6 parts of xylene were kneaded by rollers to obtain a main component.

(Curing agent)

50 Parts of a 4,4'-diphenylmethane diisocyanate solution (NCO content: 31%) was mixed with 50 parts of methyl isobutyl ketone to obtain a curing agent.

Prior to use, the above-mentioned main component and the curing agent were mixed in a weight ratio of 80:20 to obtain a solvent-type polyurethane resin coating composition (IV).

(ii) Preparation of a radical-polymerizable and oxidation-polymerizable, room temperature curing type solventless coating composition The solventless coating composition (A) of Example 1 was used.

The above-mentioned solvent-type polyurethane resin coating composition (IV) and the solventless coating composition (A) were applied, respectively, by brush coating under the conditions shown in Table 1. After drying, the formed coating film was subjected to various tests. The results thereby obtained are shown in Table 2.

EXAMPLE 5

(i) Preparation of a solvent-type chlorinated rubber coating composition 10.0 Parts of chlorinated rubber (CR-10 manufactured by Sanyo Kokusaku Pulp K.K.), 4.0 parts of chlorinated paraffin, 6.0 parts of a modified alkyd resin (oil length: 50%, non-valatile component: 50%), 1.0 part of a thixotropic agent, 9.0 parts of xylene and 70.0 parts of talc were kneaded by rollers to obtain a solvent-type chlorinated rubber coating composition (V).

(ii) Preparation of a radical-polymerizable and oxidation-polymerizable, room temperature curing type solventless coating composition The solventless coating composition (B) of Example 2 was used.

By using the above-mentioned chlorinated rubber coating composition (V) as the primer coating composition and the above-mentioned solventless coating composition (B) as the finish coating composition, the primer coating and the finish coating were applied, respectively, by brush coating under the conditions shown in Table 1. After drying, the formed coating film was subjected to various tests. The results thereby obtained are shown in Table 2.

EXAMPLE 6

(i) Preparation of a solvent-type vinyl resin coating composition 40.0 Parts of a solution of a vinyl acetate-methacrylic acid ester copolymer in a solvent mixture of methyl isobutyl ketone and xylene (non-volatile component: 50%, viscosity at 20° C.: 25 Stokes' poise), 40 parts of talc, 2.0 parts of a thixotropic agent, 8.0 parts of methyl isobutyl ketone, 8.0 parts of xylene and 2.0 parts of an additive were kneaded by rollers to obtain a solvent-type vinyl resin coating composition (VI).

(ii) Preparation of a radical-polymerizable and oxidation-polymerizable, room temperature curing type solventless coating composition The solventless coating composition (C) of Example 3 was used.

By using the above-mentioned solvent-type vinyl resin coating composition (VI) as the primer coating composition and the above-mentioned solventless coating composition (C) as the finish coating composition, the primer coating and the finish coating were applied, respectively, by brush coating under the conditions shown in Table 1. After the drying, the formed coating film was subjected to various tests. The results thereby obtained are shown in Table 2.

EXAMPLE 7

(i) Preparation of a solvent-type epoxy resin coating composition (Main component)

35.0 Parts of a xylene solution containing 70% of a solid bisphenol A type epoxy resin (the same as used in Example 3), 33.0 parts of talc, 5.0 parts of an iron oxide red coloring pigment, 1.0 part of a thixotropic agent, 20.0 parts of toluene, 5.0 parts of ethyl cellosolve and 1.0 part of an additive were kneaded by rollers to obtain a main component.

(Curing agent)

60 Parts of a polyamide resin (amine value: 150±20) was dissolved in a solvent mixture comprising 20 parts of toluene and 20 parts of ethyl cellosolve, to obtain a curing agent.

Prior to use, the above-mentioned main component and the curing agent were mixed in a weight ratio of 88:12 to obtain a solvent-type epoxy resin coating composition (VII).

(ii) Preparation of a radical-polymerizable and oxidation-polymerizable, room temperature curing type solventless coating composition The solventless coating composition (A) of Example 1 was used.

By using the above-mentioned solvent-type epoxy resin coating composition (VII) as the primer coating composition and the above-mentioned solventless coating composition (A) as the finish coating composition, the primer coating and the finish coating were applied, respectively, by brush coating under the conditions shown in Table 1. After drying, the formed coating film was subjected to various tests. The results thereby obtained are shown in Table 2.

EXAMPLE 8

(i) Preparation of a solvent-type epoxy resin coating composition (Main component)

25.0 Parts of a xylene solution containing 70% of a solid bisphenol A type epoxy resin (the same as used in Example 3), 13.0 parts of butyl dioxytol solution containing 60% of a solid bisphenol type epoxy resin (epoxy equivalent: 875–975), 18.0 parts of barium sulfate, 21.0 parts of talc, 6.0 parts of an iron oxide coloring pigment, 5.0 parts of butyl cellosolve, 10.0 parts of xylene, 1.0 part of a thixotropic agent and 1.0 part of an additive were kneaded by rollers to obtain a main component.

(Curing agent)

55 Parts of a modified aliphatic polyamine (amine value: 340–400) was dissolved in a solvent mixture comprising 15.0 parts of ethyl cellosolve, 16.0 parts of xylene and 14.0 parts of isobutanol, to obtain a curing agent.

Prior to use, the main component and the curing agent were mixed in a weight ratio of 90:10 to obtain a solvent-type epoxy resin coating composition (VIII).

(ii) Preparation of a radical-polymerizable and oxidation-polymerizable, room temperature curing type solventless coating composition The solventless coating composition (B) of Example 2 was used.

By using the above-mentioned solvent-type epoxy resin coating composition (VIII) as the primer coating composition and the above-mentioned solventless coating composition (B) as the finish coating composition, the primer coating and the finish coating were applied, respectively, by brush coating under the conditions shown in Table 1. After drying, the formed coating film was subjected to various tests. The results thereby obtained are shown in Table 2.

EXAMPLE 9

(i) Preparation of a solvent-type epoxy resin coating composition (Main component)

35.0 Parts of a mixture comprising 60.0 parts of a solid bisphenol A type epoxy resin (the same as used in Example 3), 10.0 parts of petroleum resin and 30.0 parts of xylene, were mixed with 33.0 parts of talc, 5.0 parts of titanium oxide, 1.0 part of a thixotropic agent, 20.0 parts of toluene, 5.0 parts of ethyl cellosolve and 1.0 part of an additive, and the mixture was kneaded by rollers to obtain a main component.

(Curing agent)

The curing agent prepared in Example 7 was used.

Prior to use, the main component and the curing agent were mixed in a weight ratio of 89:11 to obtain a solvent-type epoxy resin coating composition (IX).

(ii) Preparation of a radical polymerizable and oxidation-polymerizable, room temperature curing type solventless coating composition The solventless coating composition (C) of Example 3 was used.

By using the above-mentioned solvent-type epoxy resin coating composition (IX) as the primer coating composition and the above-mentioned solventless coating composition (C) as the finish coating composition, the primer coating and the finish coating were applied, respectively, by brush coating under the conditions shown in Table 1. After drying, the formed coating film was subjected to various tests. The results thereby obtained are shown in Table 2.

COMPARATIVE EXAMPLE 1

(i) Preparation of a solvent-type alkyd resin coating composition

The solvent-type alkyd resin coating composition (II) of Example 2 was used as the primer coating composition.

(ii) Preparation of a finish coating composition 40.0 parts of a mineral spirit solution of a modified soybean oil alkyd resin (oil length: 60%, non-volatile component: 70%), 25.0 parts of titanium oxide, 25 parts of barium sulfate, 0.4 part of an anti-skinning agent, 2.0 parts of a mixed drier, 1.3 parts of an additive and 6.3 parts of mineral spirit were kneaded by rollers to obtain a finish coating composition.

The above-mentioned solvent-type alkyd resin coating composition (II) and the above-mentioned finish coating composition were applied, respectively, by brush coating under the conditions shown in Table 1. After drying, the formed coating film was subjected to comparative tests. The results thereby obtained are shown in Table 2.

COMPARATIVE EXAMPLE 2

(i) Preparation of a solvent-type epoxy resin coating composition

The solvent-type epoxy resin coating composition (III) of Example 3 was used.

(ii) Preparation of a finish coating composition (Main component)

28.0 Parts of a bisphenol A type epoxy resin (epoxy equivalent: 450–500), 12 parts of xylene, 30.0 parts of talc, 10.0 parts of barium sulfate, 5.5 parts of titanium oxide, 10.0 parts of ethyl cellosolve and 1.5 parts of a thixotropic agent and a leveling agent were kneaded by rollers to obtain a main component.

(Curing agent)

70 Parts of a modified heterocyclic polyamine (solid component: 65%, amine value: 165) was dissolved in 30 parts of xylene to obtain a curing agent.

Prior to use, the above-mentioned main component and the curing agent were mixed in a weight ratio of 87:13 to obtain a finish coating composition.

The above-mentioned solvent-type epoxy resin coating composition (III) and the finish coating composition were applied, espectively, by brush coating under the conditions shown in Table 1. After drying, the formed coating film was subjected to comparative tests. The results thereby obtained are shown in Table 2.

COMPARATIVE EXAMPLE 3

(i) Preparation of a solvent-type polyurethane resin coating composition

The solvent-type polyurethane resin coating composition (IV) of Example 4 was used.

(ii) Preparation of a finish coating composition (Main component)

30.0 Parts of acrylpolyol (a xylene solution having a solid content of 50%, hydroxyl value: 50, acid value:

1.0), 25.0 parts of xylene, 5.0 parts of butyl acetate, 20.0 parts of titanium oxide, 15.0 parts of talc and 5.0 parts of an additive were kneaded by rollers to obtain a main component.

(Curing agent)

80.0 Parts of an aliphatic isocyanate compound (solid component: 75%, NCO content: 16%) was dissolved in 20.0 parts of butyl acetate to obtain a curing agent.

Immediately prior to use, the above-mentioned main component and the curing agent were mixed in a weight ratio of 85:15 to obtain a finish coating composition.

The above-mentioned solvent-polyurethane resin coating composition (IV) and the finish coating composition were applied, respectively, by brush coating under the conditions shown in Table 1. After drying, the formed coating film was subjected to comparative tests. The results thereby obtained are shown in Table 2.

COMPARATIVE EXAMPLE 4

(i) Preparation of a solvent-type chlorinated rubber coating composition

The solvent-type chlorinated rubber coating composition (V) of Example 5 was used.

(ii) Preparation of a finish coating composition

To 10.0 parts of chlorinated rubber (chlorine content: 65%), 12.0 parts of an alkyd resin, 15.0 parts of chlorinated paraffin, 20.5 parts of xylene, 15.0 parts of talc, 20.0 parts of titanium oxide and 4.5 parts of an additive were added, and the mixture was kneaded by rollers to obtain a finish coating composition.

The above-mentioned chlorinated rubber coating composition (V) and the finish coating composition were applied, respectively, under the conditions shown in Table 1. After drying, the formed coating film was subjected to comparative tests. The results thereby obtained are shown in Table 2.

COMPARATIVE EXAMPLE 5

(i) Preparation of a solvent-type vinyl resin coating composition

The solvent-type vinyl resin coating composition (VI) of Example 6 was used.

(ii) Preparation of a finish coating composition 40.0 Parts of a solution of a vinyl acetate-methacrylic acid ester copolyemr in a solvent mixture of methyl isobutyl ketone and xylene (the same as used in Example 6), 20.0 parts of titanium oxide, 25.0 parts of barium sulfate, 1.5 parts of a thixotropic agent, 7.0 parts of methyl isobutyl ketone, 7.0 parts of xylene and 1.0 part of an additive were kneaded by rollers to obtain a finish coating composition.

The above-mentioned solvent-type vinyl resin coating composition (VI) and the finish coating composition were applied, respectively, by brush coating under the conditions shown in Table 1. After drying, the formed coating film was subjected to comparative tests. The results thereby obtained are shown in Table 2.

TABLE 1

| | Coating Conditions | | | | |
|---|---|---|---|---|---|
| | Solvent-type primer coating compositions | | Finish coating compositions | | |
| | Number of coating operation | Film thickness (μm per coating operation) | Number of coating operation | Film thickness (μm per coating operation) | Total film thickness (μm) |
| Example 1 | 2 | 40 | 2 | 50. | 180 |
| Example 2 | 2 | 40 | 2 | 50 | 180 |
| Example 3 | 2 | 50 | 2 | 50 | 200 |
| Example 4 | 2 | 50 | 2 | 50 | 200 |
| Example 5 | 2 | 40 | 2 | 50 | 180 |
| Example 6 | 2 | 40 | 2 | 50 | 180 |
| Example 7 | 2 | 55 | 2 | 50 | 210 |
| Example 8 | 2 | 50 | 2 | 50 | 200 |
| Example 9 | 2 | 55 | 2 | 50 | 210 |
| Comparative Example 1 | 2 | 40 | 2 | 40 | 160 |
| Comparative Example 2 | 2 | 50 | 2 | 50 | 200 |
| Comparative Example 3 | 2 | 50 | 2 | 35 | 170 |
| Comparative Example 4 | 2 | 40 | 2 | 40 | 160 |
| Comparative Example 5 | 2 | 40 | 2 | 40 | 160 |

TABLE 2

| | Pencil hardness after coating (1) | Test results: Corrosion resistance (outdoor exposure) (2) | | | | | | | | | |
|---|---|---|---|---|---|---|---|---|---|---|---|
| | | Blister | | Rust | | Chalking | | Peeling | | Cracking | |
| | | 1 year later | 2 years later | 1 year later | 2 years later | 1 year later | 2 years later | 1 year later | 2 years later | 1 year later | 2 years later |
| Example 1 | H | 10 | 6-S | 10 | 8 | 10 | 8 | 10 | 10 | 10 | 10 |
| Example 2 | 2H | 10 | 8-VS | 10 | 8 | 10 | 8 | 10 | 10 | 10 | 10 |
| Example 3 | H | 10 | 10 | 10 | 10 | 10 | 8 | 10 | 10 | 10 | 10 |
| Example 4 | H | 10 | 10 | 10 | 8 | 10 | 8 | 10 | 10 | 10 | 10 |
| Example 5 | H | 10 | 8-VS | 10 | 8 | 10 | 8 | 10 | 10 | 10 | 10 |
| Example 6 | H | 10 | 8-VS | 10 | 8 | 10 | 8 | 10 | 10 | 10 | 10 |
| Example 7 | H | 10 | 10 | 10 | 10 | 10 | 8 | 10 | 10 | 10 | 10 |

TABLE 2-continued

| | | | | | | | | | | | |
|---|---|---|---|---|---|---|---|---|---|---|---|
| Example 8 | H | 10 | 10 | 10 | 10 | 10 | 8 | 10 | 10 | 10 | 10 |
| Example 9 | H | 10 | 10 | 10 | 10 | 10 | 8 | 10 | 10 | 10 | 10 |
| Comparative Example 1 | HB | 2-M | 0-L | 8 | 2 | 8 | 4 | 10 | 4 | 10 | E-4 |
| Comparative Example 2 | HB | 4-L | 2-L | 10 | 4 | 4 | 2 | 10 | 10 | 10 | A-8 |
| Comparative Example 3 | F | 4-M | 2-L | 10 | 6 | 10 | 8 | 10 | 10 | 10 | 10 |
| Comparative Example 4 | 2B | 2-S | 2-M | 8 | 4 | 10 | 6 | 10 | 6 | E-4 | E-8 |
| Comparative Example 5 | HB | 8-M | 2-M | 10 | 2 | 10 | 6 | 10 | 2 | 10 | E-2 |

| | Salt spray resistance (3) | Moisture resistance (4) | Gasoline resistance (5) | Pure water resistance (6) | Alkali resistance (7) |
|---|---|---|---|---|---|
| Example 1 | At least 1300 hr. | 400 hr. | 70 days | 10 days | 10 days |
| Example 2 | At least 1300 hr. | 450 hr. | 73 days | 15 days | 13 days |
| Example 3 | At least 1300 hr. | At least 1500 hr. | At least 90 days | At least 20 days | At least 90 days |
| Example 4 | At least 1300 hr. | 1300 hr. | 85 days | 19 days | 90 days |
| Example 5 | At least 1300 hr. | 700 hr. | 65 days | 15 days | 75 days |
| Example 6 | At least 1300 hr. | 600 hr. | 60 days | 12 days | 78 days |
| Example 7 | At least 1300 hr. | At least 1500 hr. | At least 90 days | At least 20 days | At least 90 days |
| Example 8 | At least 1300 hr. | At least 1500 hr. | At least 90 days | At least 20 days | At least 90 days |
| Example 9 | At least 1300 hr. | At least 1500 hr. | At least 90 days | At least 20 days | At least 90 days |
| Comparative Example 1 | 300 hr. | 30 hr. | 2 days | 2 days | 3 days |
| Comparative Example 2 | 800 hr. | 450 hr. | 35 days | 5 days | 35 days |
| Comparative Example 3 | 600 hr. | 400 hr. | 35 days | 5 days | 30 days |
| Comparative Example 4 | 500 hr. | 250 hr. | 1 day | 4 days | 3 days |
| Comparative Example 5 | 350 hr. | 250 hr. | 1 day | 3 days | 2 days |

(1) In accordance with JIS K-5400

(2) Substrate: The coating was applied to the outer surface of a cooling water circulating pipe (internal temperature: 15–20° C. throughout year, outer circumference in the exposed state: about 80 cm) at Kashima Plant of Mitsubishi Petrochemical Co., Ltd., and the coating film was evaluated one year later and 2 years later. The numerical values in each item are in accordance with "Standards for Evaluation of Paint Film" issued by Japan Paint Inspecting Association. (all based on 50 $cm^2$)

10: no defects

Blister

8-VS: The height of blisters: about 0.1 mm, the surface area of blisters: 0.5%
2-S: The height of blisters: about 0.5 mm, the surface area of blisters: 30%
6-S: The height of blisters: about 0.5 mm, the surface area of blisters: 5%
2-M: The height of blisters: about 1 mm, the surface area of blisters: 25%
4-M: The height of blisters: about 1 mm, the surface area of blisters: 10%
8-M: The height of blisters: about 1 mm, the surface area of blisters: 0.5%
0-L: The height of blisters: about 2 mm, the surface area of blisters: 31%
2-L: The height of blisters: about 2 mm, the surface area of blisters: 11%
4-L: The height of blisters: about 2 mm, the surface area of blisters: 6%

Rust

2: Rust formed on the entire surface, partial peeling observed
4: Rust formed on the entire surface
6: Spot rust formed (20 spots)
8: Spot rust formed (5 spots)

Chalking

2: The surface area of chalking: 80%
4: The surface area of chalking: 50%
6: The surface area of chalking: 30%
8: Slight chalking observed (the surface area of 10% or less)

Peeling

TABLE 2-continued

2: The peeled surface area: 10%
4: The peeled surface area: 5%
6: The peeled surface area: 2%
Cracking
A-8: Straight line crackings (length: 1 cm), 8 crackings
E-2: Irregular crackings formed to a great extent
E-4: Irregular crackings formed to a considerable extent
E-8: Irregular crackings, 5-6 crackings
(3) Cross cut lines reaching the substrate were formed on the coating surface of the test piece, and then the test piece was subjected to a salt spray test (JIS K-5400, 7.8), whereby the time for the formation of rust was measured.
(4) The test was conducted at a temperature of 49 ± 1° C. at a relative humidity of 97%, whereby the time for the formation of blisters was recorded.
(5) The test piece was immersed in gasoline at 25° C., whereby the number of days for the formation of abnormality such as the solubilization of the coating film, the degradation of the gloss or the formation of blisters was recorded.
(6) The test piece was immersed in pure water at 60° C., whereby the number of days for the formation of blisters was recorded.
(7) The test piece was immersed in a 3% NaCl solution at 60° C., whereby the number of days for the formation of blisters was recorded.

It is evident from the results of the comparative tests that the coating films formed by the process of the present invention have superior interlayer adhesion and they are free from the formation of blisters or crackings. Whereas, in the Comparative Examples wherein the conventional finish coating compositions were used, the formation of blisters was observed and the formation of rusts, chalking, peeling and crackings was also observed.

Further, the coating films formed by the process of the present invention are superior also in the salt water resistance, the moisture resistance, the gasoline resistance, the pure water resistance and the alkali resistance. Particularly when a composition comprising a bisphenol type epoxy resin as the vehicle was used as the solvent-type primer coating composition, a coating film was obtained which was far superior to other coating films.

What is claimed is:

1. A process for forming a corrosion resistant coating, which comprises (i) a step of priming a solvent-type coating composition on a corrodible substrate and drying it to form a prime coat, and (ii) a step of coating a radical-polymerizable, and oxidation-polymerizable, room temperature curing solventless coating composition on the dry prime coat and polymerizing it to form a cured coating, wherein the solvent-type coating composition contains a volatile organic solvent and is selected from the group consisting of a boiled drying oil coating composition, an alkyd resin coating composition, an epoxy resin coating composition, a polyurethane resin coating composition, a chlorinated rubber coating composition and a vinyl resin coating composition, and wherein the radical-polymerizable and oxidation-polymerizable, room temperature curing solventless coating composition is composed essentially of a curing catalyst and a resin component comprising (A) from 30 to 70% by weight an oil-modified alkyd resin having an oil length of from 30 to 70% and modified with an $\alpha,\beta$-unsaturated monocarboxylic acid selected from the group consisting of sorbic acid, crotonic acid and 2-($\beta$-furyl) acrylic acid, the content of the $\alpha,\beta$-unsaturated monocarboxylic acid in the alkyd resin being from 0.5 to 30% by weight, and (B) from 70 to 30% by weight of a polymerizable monomer in which the ingredient (A) is dissolved.

2. The process according to claim 1, wherein the solvent-type coating composition is a coating composition comprising a bisphenol epoxy resin as the vehicle.

3. Process according to claim 2, wherein the polymerizable monomer (B) has a boiling point exceeding 200° C.

4. The process according to claim 2, wherein both the solvent-type coating composition and the solventless coating compositions includes a pigment.

* * * * *